United States Patent [19]

Jungwirth et al.

[11] 4,192,114

[45] Mar. 11, 1980

[54] ARRANGEMENT FOR INTERCONNECTING BUNDLES OF PRESTRESSING TENDONS FOR PRESTRESSED CONCRETE

[75] Inventors: Dieter Jungwirth, Münich; Josef Renoth, Landshut-Altdorf; Johann Wlodkowski, Münich, all of Fed. Rep. of Germany

[73] Assignee: Dyckerhoff & Widmann Aktiengesellschaft, Munich, Fed. Rep. of Germany

[21] Appl. No.: 860,385

[22] Filed: Dec. 14, 1977

[30] Foreign Application Priority Data

Dec. 17, 1976 [DE] Fed. Rep. of Germany ..... 2657202

[51] Int. Cl.[2] ..... E04C 3/10

[52] U.S. Cl. ..... 52/230; 52/223 L

[58] Field of Search ..... 52/230, 223 L, 223 R, 52/227, 228

[56] References Cited

U.S. PATENT DOCUMENTS

| | | | |
|---|---|---|---|
| 3,307,310 | 3/1967 | Kourkene | 52/230 |
| 3,427,772 | 2/1969 | Williams | 52/230 |
| 3,803,785 | 4/1974 | Finsterwalder | 52/230 |

FOREIGN PATENT DOCUMENTS

| | | | |
|---|---|---|---|
| 2360667 | 6/1974 | Fed. Rep. of Germany | 52/230 |
| 2423741 | 11/1975 | Fed. Rep. of Germany | 52/230 |
| 6705498 | 10/1967 | Netherlands | 52/230 |
| 201039 | 1/1966 | Sweden | 52/230 |
| 1125176 | 8/1968 | United Kingdom | 52/230 |

*Primary Examiner*—James A. Leppink
*Assistant Examiner*—Henry E. Raduazo
*Attorney, Agent, or Firm*—Toren, McGeady and Stanger

[57] ABSTRACT

For use in prestressed concrete structures, an arrangement is provided for interconnecting serially arranged longitudinally extending bundles of prestressing tendons. Each bundle passes through a separate section of the structure with the sections being poured one after the other. The ends of a bundle extending through a first poured section are secured centrally within an anchorage member. The ends of the following bundle in the next section are secured to the same anchorage member in an annular part radially outwardly of the centrally secured ends of the first bundle. From the anchorage member, the tendons in the following bundle converge inwardly to a point spaced from the anchorage member where they are enclosed within a tubular sheathing in a normal close spacing. The end of the sheathing is trumpet shaped, diverging toward the anchorage member. The end of the trumpet shaped section closer to the anchorage member, is spaced from the anchorage member so that a longitudinally extending section of the tendons in the following bundle is directly enclosed by concrete when the second section of the structure is poured.

8 Claims, 4 Drawing Figures

ARRANGEMENT FOR INTERCONNECTING BUNDLES OF PRESTRESSING TENDONS FOR PRESTRESSED CONCRETE

SUMMARY OF THE INVENTION

The present invention is directed to an arrangement providing intermediate anchoring of serially arranged bundles of prestressing tendons used in a prestressed concrete structure. Each bundle of tendons is longitudinally arranged within a tubular sheathing and can be post-tensioned, that is, tensioned after the tendons and sheathing are enclosed by the poured concrete of the structure. The arrangement is directed to interconnecting a bundle of prestressing tendons located within an already completed section of the concrete structure to a following bundle located in the next following section of the structure. The tendons in the poured section are secured in a centrally arranged part of an anchorage member. The tendons for the next section are positioned in the anchorage member spaced radially outwardly from the centrally arranged ends of the other bundle. From the anchorage member the tendons in the radially outwardly spaced part converge inwardly to a normal spacing at a position located axially some distance from the anchorage member.

Bundles of prestressing tendons for a prestressed concrete structure consists of a number of single elements, such as wires, strands or rods. For producing prestressed concrete with subsequent bonding, the elements extend longitudinally through and are movably displaceable within sheathing members, such as pipes. Accordingly, it is possible to tension these elements after the concrete in that part of the structure has been poured and set. After the elements are tensioned, the hollow spaces between the individual elements within the sheathing member can be filled with grout.

Within the sheathing member, the individual elements or tendons are spaced closely apart and they are located in position by spacers. To accommodate anchoring parts, such as nuts, wedges and the like, at the anchorage members, the individual tendons are disposed in diverging relationship from the normally close spacing within the sheathing to afford increased spacing between adjacent tendons and facilitate the anchoring operation.

When a concrete structure, such as a multiple span bridge, is constructed in sections, the bundles of prestressing tendons in adjacent sections have to be interconnected by intermediate anchoring devices or interconnecting arrangements. At such an intermediate anchoring location, the tendons in the bundle extending longitudinally from the section of the structure previously poured can only be connected to an anchorage member in a position spaced radially outwardly from the anchored ends of the tendons in the bundle extending through the already poured section. This condition exists because the bundle in the section not yet poured can only be placed after the tendons in the previously poured section have been tensioned. As a result, the tendons in the section to be poured must converge inwardly along a longitudinal path to the normally close spacing of the tendons extending through the sheathing. In those longitudinally extending areas where the tendons are in converging relation, problems exist with transverse compression which may lead to an early failure of the tendons.

At the location of the interconnection of serially arranged bundles of prestressing tendons, the tendons in the anchorage member are arranged parallel to the longitudinal axis of the bundle. To provide convergence of the tendons, two deflection points are required in each tendon with each point deflecting in an opposite direction. Both transverse compressive and tension forces occur at these deflection points. The transverse compressive forces are absorbed by a deflection body formed of cast iron and having the shape of a truncated cone, while the transverse tension forces are absorbed by the concrete surrounding the bundle. Adjacent the anchorage member, the tendons are laterally enclosed by sheathing which widens toward the anchorage in the shape of a trumpet. After the prestressing tendons extending through the section to be poured have been tensioned, the interior of the sheathing is grouted, note OE-PS 331,475.

At these known intermediate interconnecting locations there is the disadvantage that a relatively large hollow space exists in the interior of the trumpet-shaped sheathing which must be grouted with cement mortar. If air is removed from this hollow space during the grouting operation, there is the danger that air bubbles may remain and that the individual prestressing tendons will not be sufficiently completely enclosed by the grouting material. If such a condition exists, there is the possibility that the prestressing tendons may corrode and that in this area of extreme stresses, the forces may not be absorbed in a satisfactory manner.

Accordingly, it is the primary object of the present invention to provide an interconnecting arrangement such that the intermediate anchorage member and the individual prestressing tendons are satisfactorily completely enclosed for affording reliable corrosion protection and the absorption of the forces acting at that location.

In accordance with the present invention, at the location of an intermediate anchorage between two serially arranged bundles of prestressing tendons, one bundle extending through a previously poured section and the second bundle extending through a section to be poured, the tendons in the section to be poured, located adjacent to the intermediate anchorage member, are not enclosed within sheathing for at least a portion of the length of the deflection path of the tendons, that is, the path between the anchorage member and the point at which the tendons are disposed in the normally close spacing provided within the sheathing. As a result, the end of the sheathing adjacent to the intermediate anchorage member is spaced from the anchorage member with the tendons extending between the anchorage member and the adjacent end of the sheathing being completely enclosed within and in direct contact with the concrete in the section when it is poured.

Preferably, the intermediate anchorage member is in the form of a coupling disk spaced from the adjacent end of the previously poured section of concrete. A spacer pipe laterally encloses the tendons extending from the previously poured section and contacts at one end the surface of the coupling disk and at the other end an anchoring body incorporated into the previously poured section of concrete. The surface of the coupling disk facing away from the previously poured section may be slightly compressible. This compressible feature can be afforded by arranging a thin layer of a compressible material on the surface of the coupling disk.

For a portion of the deflection path of the bundle of prestressing tendons, a trumpet-shaped sheathing pipe can be laterally arranged around the tendons. This trumpet-shaped pipe is advantageously closed off by a cover at its end closer to the intermediate anchorage member. Cross ribs, that is ribs extending transversely of the longitudinal direction of the tendons, can be provided on the interior surface of the trumpet-shaped sheathing pipe so that the ribs provide support points for the prestressing tendons as they extend along the deflection path.

One advantage of the invention is the incorporation of the individual tendons of the bundle in concrete for a portion of the deflection path extending from the intermediate anchorage member. At this location there is a large spacing between the individual tendons and substantial forces act on the individual tendons. Since the tendons are fixed in concrete at this location, it is ensured that the concrete at this location has the same characteristics as in other portions of the prestressed concrete structure. Moreover, the individual tendons are protected against corrosion and the existing deflection forces are yieldingly absorbed by the concrete surrounding the tendons, that is, there are no intermediate metallic parts between the tendons and the concrete. Since this location where the concrete is in direct contact with the tendons is relatively short with respect to the length of the tendons and, because no significant stretching will occur immediately adjacent to the intermediate anchorage member, there is no danger that part of the tension force will be transmitted into the concrete at a location spaced from the intermediate anchorage member. The extent of the location at which the individual tendons are directly bonded to the concrete is so short that the tensional forces will travel to the actual anchoring member. To facilitate a slight yielding of the structure forming the intermediate anchorage member, its surface facing toward the deflection path of the tendons can be made compressible.

Preferably, the linear extent of the location in which the individual tendons are directly incorporated into the concrete is such that concrete can be placed about and compacted around the tendons without any difficulties. Where the spacing of the tendons becomes such that placement and compaction of the concrete would be a problem, the converging tendons are enclosed within a trumpet-shaped sheathing pipe which is connected to the normal sheathing around the prestressing tendons where they are in the normal close spacing. The open spaces within the sheathing are filled with grout after the tensioning of the tendons. To assure that the individual tendons are completely enclosed by grout within the sheathing, the trumpet-shaped sheathing pipe is provided with cross ribs on its interior surface and the ribs provide bearing points for the individual tendons. At these bearing points provided by the ribs, the deflection forces within the tendons are directly transmitted to the concrete through the medium of the sheathing pipe which, preferably, is formed of a plastic providing a soft contact surface.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
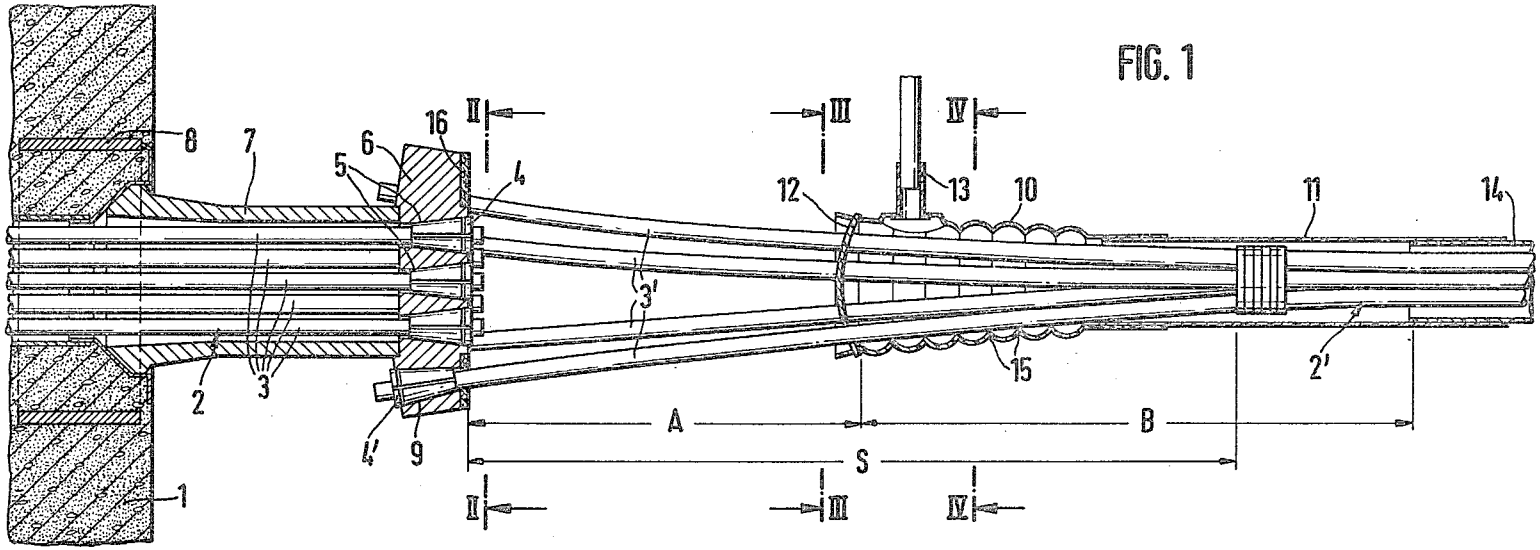
FIG. 1 is a longitudinal sectional view through an intermediate coupling location and it illustrates the present invention.
Figure 4:
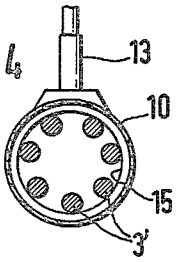
FIG. 4 is a transverse cross section taken along the line IV—IV in FIG. 1.
Figure 3:
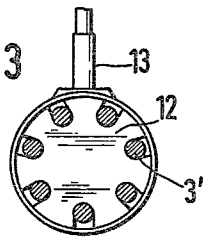
FIG. 3 is a transverse cross section taken along the line III—III in FIG. 1.
Figure 2:
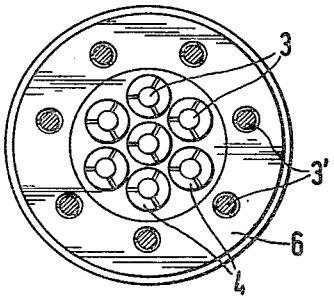
FIG. 2 is a transverse cross section taken along the line II—II in FIG. 1.

As shown in FIG. 1 a bundle of prestressing tendons 2 project outwardly from one end or side of a poured section 1 of a concrete structure. The bundle of prestressing tendons 2 consists of a plurality of separate elements, such as wires or strands 3. As illustrated, the bundle 2 consists of seven tendons or strands 3. As shown in FIG. 2, in the portion of the bundle 2 extending outwardly from the poured section 1, one tendon is located centrally along the axis of the bundle while the remaining six tendons are spaced radially outwardly from the central tendon and are arranged in a circle about the central tendon. Each of the tendons is anchored by wedges 4 within a tapered bore 5 in the central part of a coupling disk 6. The coupling disk 6 is spaced in the axial direction of the bundle 2, outwardly from the poured section 1. Encircling the tendons 3 between the poured section 1 and the coupling disk 6, is a spacer pipe 7. At one end, the spacer pipe 7 bears against the surface of the coupling disk 6 and at its other end it bears against an anchoring body 8 incorporated into the concrete in the poured section 1. It will be appreciated that another poured section of the concrete structure will extend from the poured section 1 in the direction to the right as shown in FIG. 1.

As shown in FIGS. 1 and 2, a circle of second bores 9 are provided radially outwardly from the central part of the coupling disk 6 containing the bores 5. Individual tendons 3′ of a bundle of prestressing tendons 2′ extending through the next section of concrete to be poured from the poured section 1, are anchored within the second bores 9 by means of wedges 4′. From the coupling disk 6, the individual tendons 3′ converge inwardly along a deflection path S to a point where the tendons are in their normally close spacing. The tendons 3′ are bent slightly from the parallel arrangement of the normally close spacing toward the coupling disk.

For a portion of the deflection path S of the tendons 3′, indicated by the length A, the tendons are completely uncovered. For the remaining length B of the deflection path, the tendons 3′ are enclosed by a first sheathing pipe 10 which is trumpet-shaped and is connected at its smaller end through a compensating pipe 11 to a second sheathing pipe 14. Within the pipe 10 radially inwardly extending ribs 15 form point-like supports for the tendons. The sheathing pipe 14 encloses the tendons 3′ where they are arranged in their normally close spacing. The larger end of the first sheathing pipe 10, that is the end closer to the coupling disk 6, is closed by a cover 12. A breather hose and a grouting hose can be connected to the first sheathing pipe 10 through a pipe connector 13. Preferably, the first sheathing pipe 10, the compensating pipe 11 and the second sheathing pipe 14 are formed of a plastics material.

After the assembly of the bundle prestressing tendons 2' as shown in FIG. 1, the next section of the concrete structure is poured so that the bundle along with its sheathing, the coupling disk and the spacer pipe are enclosed in concrete. For the extent of the length A, the tendons 3' are directly enclosed by the concrete, that is, the concrete is in direct contact with the surfaces of the tendons. Within the sheathing pipe 10 and the compensating pipe 11, the individual tendons 3' are longitudinally movable. After the concrete has been poured and set in the section containing the bundle of prestressing tendons 2', the bundle is tensioned. Bonding in the space between the anchoring body 8 and the coupling disk 6 is so insignificant that the tensional force is transmitted to the coupling disk without reduction. To achieve satisfactory prestressing of the concrete in this space between the anchoring body 8 and the coupling disk 6, a thin layer 16 of a compressible material is placed on the surface of the coupling disk facing away from the spacer pipe 7. Accordingly, small movements of the coupling disk 6 are possible.

In the length A of the deflection path S, the deflection forces created during tensioning are directly transmitted to the concrete which in this length A is in direct contact with the individual tendons 3'. After tensioning the bundle 2', the interior of the sheathing structure, including the trumpet-shaped sheathing pipe 10 and the compensating pipe 11, is filled with grout. Any air in this grouted space is allowed to escape through the breather line 13. Accordingly, the tendons 3' within the sheathing structure are enclosed by grout and the presence of any air bubbles is avoided which could lead to reduce corrosion protection.

What is claimed is:

1. An arrangement forming an intermediate anchorage between an axially extending first bundle and an axially extending second bundle of longitudinal prestressing tendons for a prestressed concrete structure with said first and second bundle disposed in serial and general axial alignment, said first bundle arranged to be located within a first poured concrete section of the structure and said second bundle arranged to be located within a second poured concrete section which is contiguous to and is poured after the first section, means for enclosing said second bundle throughout a portion of the axial length for maintaining said tendons out of contact with the concrete poured in said second section, said means including an axially elongated tubular sheathing member for said bundle, said tubular sheathing member enclosing said second bundle for a part of its axial length and the tendons of said second bundle within said tubular sheathing member being in substantially parallel relation and having a normally close spacing about the longitudinal axis of said tubular sheathing member, said tendons being capable of post-tensioning and being longitudinally movable within said means for enclosing said second bundle, a disk-shaped anchorage member having a central part and a radially outer part extending circumferentially around said central part, said central part having the axis thereof in general axial alignment with the axes of said first and second bundles, said anchorage member located in said second concrete section between the end of said first concrete section adjacent to said second concrete section and the adjacent end of said means for enclosing said second bundle, said anchorage member disposed in axially spaced relation from the adjacent end of said means enclosing said second bundle, the tendons of said first bundle being anchored in said central part, the tendons of said second bundle being anchored in said radially outer part radially outwardly from the tendons of said first bundle and being spaced apart a greater distance radially outwardly from the longitudinal axis of said bundle than in the normally close spacing within said tubular sheathing member, the tendons of said second bundle converging inwardly relative to one another from the spacing in said anchorage member as then extend longitudinally from said anchorage member into the normally close spacing within said tubular sheathing member, and the adjacent end of said tubular sheathing member for said second bundle located closer to said anchorage member is spaced in the longitudinal direction of said tendons from said anchorage member so that when concrete is poured in the second section at least a longitudinally extending part of the tendons in said second bundle extending between said anchorage member and the point at which the tendons are in normally close spacing within said tubular sheating member is not covered by said means for enclosing said second bundle and is directly encased in the poured concrete of said second poured concrete section.

2. An arrangement, as set forth in claim 1, wherein said anchorage member comprises a coupling disk extending transversely of the axial direction of said first and second bundle and containing said central part and said radially outer part, an anchoring body laterally disposed about said first bundle and arranged to be enclosed within the first section of the concrete structure with said anchoring body being spaced from said anchorage member, and a spacer pipe laterally enclosing the end of said first bundle secured to said central part of said anchorage member and extending between said anchoring body and said anchorage member.

3. An arrangement, as set forth in claim 2, wherein the surface of said coupling disk facing away from said spacer pipe being compressible.

4. An arrangement forming an intermediate anchorage between an axially extending first bundle and an axially extending second bundle of longitudinally prestressing tendons for a prestressed concrete structure with said first and second bundles disposed in serial and general axial alignment, tubular sheathing laterally enclosing each said bundle for a part of its axial length and the tendons of each said bundle having a normally close spacing about a longitudinal axis within said sheathing, said tendons being capable of post-tensioning and being longitudinally movable within said tubular sheathing, said first bundle arranged to be located with a first concrete section of the structure and said second bundle arranged to be located within a second concrete section which is adjacent to and is to be poured after the first section, an annular anchorage member having a central part and a radially outer annular part extending circumferentially around said central part, said annular anchorage member located in said second concrete section between the end of said first concrete section adjacent to said second concrete section and the adjacent end of said tubular sheathing, said annular anchorage member disposed in axially spaced relation from said tubular sheathing enclosing said second bundle, the tendons of said first bundle being anchored in said central part, the tendons of said second bundle being anchored in said annular part radially outwardly from the tendons of said first bundle and being spaced apart a greater distance radially outwardly from the longitudinal axis of said bundle than in the normally close spacing within said sheathing, the tendons of said second bundle converging inwardly relative to one another from the spacing in said anchorage member as they extend longitudinally from said anchorage member into the normally close spacing within said tubular sheathing, and the adjacent end of said tubular sheathing for said second bundle located closer to said anchorage member is spaced in the longitudinal direction of said tendons from said anchorage member so that when concrete is poured in the second section at least a longitudinally extending part of the tendons in said second bundle extending between said anchorage member and the point at which the tendons are in the normally close spacing within said sheathing is not covered by said sheathing and is directly encased in the poured concrete, said anchorage member comprises a coupling disk extending transversely of the axial direction of said first and second bundles and containing said central part and said outer annular part, an anchoring body laterally disposed about said first bundle and arranged to be enclosed within the first section of the concrete structure with said anchoring body being spaced from said anchorage member, and a spacer pipe laterally enclosing the end of said first bundle secured to said central part of said anchorage member and extending between said anchoring body and said anchorage member, the surface of said coupling disk facing away from said spacer pipe being compressible, a thin layer of compressible material is positioned on the surface of said coupling disk facing away from said spacer pipe.

5. An arrangement, as set forth in claim 1, wherein said means for enclosing said second bundle includes a trumpet-shaped pipe located at and connected to the end of said tubular sheathing member enclosing said second bundle which is closer to said anchorage member and the trumpet-shaped pipe extending from its end closer to said anchorage member toward the point at which the tendons in said second bundle are in the normally close spacing within said sheathing, and said trumpet-shaped member converging in the direction away from said anchorage member.

6. An arrangement forming an intermediate anchorage between an axially extending first bundle and an axially extending second bundle of longitudinal prestressing tendons for a prestressed concrete structure with said first and second bundles disposed in serial and general axial alignment, tubular sheathing laterally enclosing each said bundle for a part of its axial length and the tendons of each said bundle having a normally close spacing about a longitudinal axis within said sheathing, said tendons being capable of post-tensioning and being longitudinally movable within said tubular sheathing, said first bundle arranged to be located with a first concrete section of the structure and said second bundle arranged to be located with a second concrete section which is adjacent to and is to be poured after the first section, an annular anchorage member having a central part and a radially outer annular part extending circumferentially around said central part, said annular anchorage member located in said second concrete section between the end of said first concrete section adjacent ot said second concrete section and the adjacent end of said tubular sheathing, said annular anchorage member disposed in axially spaced relation from said tubular sheathing enclosing said second bundle, the tendons of said first bundle being anchored in said central part, the tendons of said second bundle being anchored in said annular part radially outwardly from the tendons of said first bundle and being spaced apart a greater distance radially outwardly from the longitudinal axis of said bundle than in the normally close spacing within said sheathing, the tendons of said second bundle converging inwardly relative to one another from the spacing in said anchorage member as they extend longitudinally from said anchorage member into the normally close spacing within said tubular sheathing, and the adjacent end of said tubular sheathing for said second bundle located closer to said anchorage member is spaced in the longitudinal direction of said tendons from said anchorage member so that when concrete is poured in the second section at least a longitudinally extending part of the tendons in said second bundle extending between said anchorage member and the point at which the tendons are in the normally close spacing within said sheathing is not covered by said sheathing and is directly encased in the poured concrete, said tubular sheathing includes a trumpet-shaped pipe located at and connected to the end of said sheathing enclosing said second bundle which is closer to said anchorage member and the trumpet-shaped pipe extending from its end closer to said anchorage member toward the point at which the tendons in said second bundle are in the normally close spacing within said sheathing, and said trumpet-shaped member converging in the direction away from said anchorage member and a cover is disposed across the end of said trumpet-shaped pipe closer to said anchorage member and forms a closure therefor blocking concrete from entering said trumpet-shaped pipe and said sheathing connected thereto.

7. An arrangement, as set forth in claim 6, wherein said trumpet-shaped pipe having radially inwardly extending ribs in the inner surface thereof with said ribs extending transversely of the longitudinal direction of said tendons passing therethrough and with said ribs forming point-like supports for said tendons extending therethrough.

8. A method of interconnecting serially arranged axially extending bundles of prestressing tendons in a prestressed concrete structure where each serially arranged bundle is located in a separately poured section of the structure in axial alignment with the adjacent bundles, comprising anchoring the ends of a first bundle within an anchorage member spaced from the poured section containing the first bundle and locating the ends centrally within the anchorage member, anchoring the ends of a next succeeding second bundle within the anchorage member and locating the ends of said second bundle in a ring-like arrangement radially outwardly from the anchored ends of the first bundle, extending the tendons in the second bundle axially away from the anchorage member and moving the tendons inwardly closer to one another into a normally close spacing at a location spaced axially from the anchorage member, laterally enclosing the tendons of the second bundle within a sheathing and spacing the end of the sheathing closer to the anchorage member axially from the anchorage member and closing off the end of the sheathing, and pouring concrete in the section of the concrete structure containing the second bundle so that the concrete directly encases and contacts the tendons of said second bundle directly adjacent to the anchoring member and directly encases the sheathing so that the sheathing maintains the tendons within the sheathing out of direct contact with the concrete poured in the section containing the second bundle.

* * * * *